US007163061B2

(12) United States Patent
Moncus et al.

(10) Patent No.: US 7,163,061 B2
(45) Date of Patent: Jan. 16, 2007

(54) APPARATUS AND METHOD FOR SUPPORTING STRUCTURES ON OFFSHORE PLATFORMS

(75) Inventors: James Devin Moncus, Lafayette, LA (US); Joseph Hayden Miller, Jr., Lafayette, LA (US)

(73) Assignee: Devin International, Inc., Lafayette, LA (US)

( * ) Notice: Subject to any disclaimer, the term of this patent is extended or adjusted under 35 U.S.C. 154(b) by 303 days.

(21) Appl. No.: 10/797,875

(22) Filed: Mar. 10, 2004

(65) Prior Publication Data

US 2005/0199400 A1 Sep. 15, 2005

(51) Int. Cl.
*E21B 7/12* (2006.01)

(52) U.S. Cl. ..... 166/355; 405/196; 114/264

(58) Field of Classification Search ..... 166/355; 114/264; 405/196, 203
See application file for complete search history.

(56) References Cited

U.S. PATENT DOCUMENTS

RE27,261 E * 12/1971 Bromell et al. ..... 114/264
3,791,628 A * 2/1974 Burns et al. ..... 254/277
4,856,827 A * 8/1989 Delamare ..... 285/268
4,883,388 A * 11/1989 Cherbonnier ..... 405/195.1
4,886,397 A * 12/1989 Cherbonnier ..... 405/195.1
6,171,027 B1 * 1/2001 Blankestijin ..... 405/201
6,585,455 B1 * 7/2003 Petersen et al. ..... 405/224.4
6,772,840 B1 * 8/2004 Headworth ..... 166/302
6,932,553 B1 * 8/2005 Roodenburg et al. .... 414/22.51

* cited by examiner

*Primary Examiner*—Thomas A Beach
(74) *Attorney, Agent, or Firm*—C. Dean Domingue; Robert L. Waddell; Ted M. Anthony

(57) ABSTRACT

An apparatus for supporting a structure on a platform. The platform may be a floating platform. The apparatus comprises a base frame, wherein the base frame has a first bracket and a second bracket attached thereto. The apparatus further includes a x-axis frame having a first pivot point and a second pivot point. The apparatus further comprises a z-axis frame having a third pivot point and a fourth pivot point. A sliding frame assembly is operatively positioned within the z-axis frame, and wherein the sliding frame assembly has a plurality of rods for connecting with an injector head. The apparatus may further include a motion restriction system that restricts movement of the x-axis frame and the z-axis frame. The sliding frame assembly comprises a sliding pad for lateral movement. A method for compensating for the movement of a floating platform having a riser extending therefrom is also disclosed.

15 Claims, 9 Drawing Sheets

APPARATUS AND METHOD FOR SUPPORTING STRUCTURES ON OFFSHORE PLATFORMS

BACKGROUND OF THE INVENTION

This invention relates to a structure for supporting structures on offshore platforms. More particularly, but not by way of limitation, this invention relates to a structure and method for supporting and compensating for movement during well intervention operations on offshore platforms.

Hydrocarbons are located in subterranean reservoirs. The search for hydrocarbons has brought operators to remote and exotic areas of the globe. Deep water tracts have been explored and drilled with increasing frequency in recent years. Platforms set in waters of 1,000 to 2,000 feet have become common place, and in some instances, wells have been drilled in water depths of over 5,000 feet. Different types of drilling and production platforms have been used in these deep waters. One type of platform is a tension leg platform (TLP). In the TLP, a floating platform is connected to the ocean floor via tendons such as steel cables, as is well understood by those of ordinary skill in the art. Another type of structure used in deep water is the spar platform which generally is a floating cylindrical structure that is anchored to the ocean floor with steel cable means. Other types of floating platforms are known in the art. In deep water, a fixed leg type of platform is generally not an option due to the extreme water depths. The exploration, drilling, completion and production in these deep waters is very expensive. For instance, day rental rates for floatable drilling rigs can cost over $300,000 per day in some instances.

Wave conditions may cause a cyclic buoyant force on these floating platforms based on the raising, lowering, heaving and pitching of the platform. Moreover, tidal conditions may cause a variation in platform height and cause similar buoyant forces. The applied forces will in turn cause motion on the platform and on the work deck of the platform. Additionally, the subterranean well that is drilled will have a riser extending from the sea floor to the platform. In other words, a riser extends from the sea floor to the floating platform. As will be understood by those of ordinary skill in the art, the riser generally does not move in unison with the platform since the riser is fixed to the sea floor by different attachment means. Also, the riser does not experience the same buoyant forces as the floating platform.

While an operator is in the midst of performing well work, the motion of the platform can have detrimental effects on the equipment and ongoing operations. For example, a coiled tubing unit that is rigged-up and running a string of tools into the well could be lifted upward and/or downward, and/or sideways due to the motion of the platform. This motion could potentially cause serious damage such as breaking the connection of the coiled tubing to the riser which in turn could lead to a catastrophic failure. With prior art designs, operators find it necessary to stop operations and rig down the connection and then reconfigure the equipment.

In the course of performing well intervention work on these offshore wells, the operator must install numerous devices such as coiled tubing injector heads, lubricators, blow out preventors, etc. As readily understood by those of ordinary skill in the art, numerous operational problems may be encountered before, during and after the well intervention work. Hence, operators may find it necessary to rig down certain equipment. In the past, and upon experiencing operational problems, equipment such as the coiled tubing injector head would have to be rigged down so that the encountered problem could be solved. However, due to the various movements being experienced by the floating platform, alignment of the equipment is difficult. A significant amount of time must be spent in rigging up equipment, which equates to significant sums of money due to the day rates of the rig.

Thus, there is a need for a system and method that will allow an operator to move components of a well intervention string assembly with greater ease and simplicity. There is also a need to compensate for motion of a floating platform while undergoing well intervention procedures. These needs, and many other needs, will be met according to the teachings of the present invention.

SUMMARY OF THE INVENTION

An apparatus for supporting an injector head is disclosed. The apparatus comprises a base frame mounted to a platform, wherein the base frame has a first bracket and a second bracket attached thereto. The apparatus further includes an x-axis frame having a first pivot point and a second pivot point, and wherein the first pivot point is pivotly connected to the first bracket and the second pivot point is pivotly connected to the second bracket so that the x-axis frame is movable along an x-axis, and wherein the x-axis frame has a third bracket and a fourth bracket.

The apparatus further comprises a z-axis frame having a third pivot point and a fourth pivot point, and wherein the third pivot point is pivotly connected to the third bracket and the fourth pivot point is pivotly connected to the fourth bracket, and wherein the upper frame is movable along the z-axis. A sliding frame assembly is operatively positioned within the z-axis frame, with the sliding frame assembly having a plurality of rods, and wherein the injector head is operatively connected to the rods.

The apparatus further includes a top plate attached to the z-axis frame so that a cavity is formed, and wherein the sliding frame assembly is contained within the cavity. The apparatus may further include a motion restriction means for restricting the x-axis frame movement along the x-axis and the z-axis frame movement along the z-axis. The apparatus may also contain locking means for locking the sliding frame assembly.

In one preferred embodiment, the sliding frame assembly comprises a sliding layer and an adapter frame. The sliding layer may comprise a fabric so that the fabric slides on the surface of the z-axis frame. Also, in one preferred embodiment, the injector head is connected to a riser and wherein the base frame is connected to a floating platform. Also, in one preferred embodiment, the base frame is mounted on a track stack structure, and the track stack structure is mounted to the platform.

The motion restriction means may comprise an x-axis biasing means for biasing the x-axis frame along the x-axis, and a z-axis biasing means for biasing the z-axis frame along the z-axis.

In one preferred embodiment, the x-axis biasing means comprises a first hydraulic cylinder attached to the base frame and a first piston extending from the first hydraulic cylinder, and wherein the first piston is attached to the x-axis frame. In the preferred embodiment, the z-axis biasing means comprises a second hydraulic cylinder attached to the x-axis frame and a second piston extending from the second hydraulic cylinder, the second piston being attached to the z-axis frame.

A method for compensating for the movement of a floating platform having a riser extending therefrom is also disclosed. The method comprises providing an apparatus comprising: a base frame mounted to the platform; a x-axis frame having a first pivot point and a second pivot point, and wherein the first and second pivot point is pivotly connected to a first and second bracket on the base frame so that the x-axis frame is movable along an x-axis, and wherein the x-axis frame has a third bracket and a fourth bracket; a z-axis frame having a third pivot point and a fourth pivot point, and wherein said third pivot point is pivotly connected to said third bracket and said fourth pivot point is pivotly connected to the fourth bracket, and wherein the z-axis frame is movable along the z-axis.

The method includes moving the platform due to wave action and pivoting the z-axis frame about the third and fourth pivot point. The method further includes pivoting the x-axis frame about the first and second pivot point. In one preferred embodiment, the apparatus has a sliding frame assembly operatively associated with the z-axis frame, and wherein the method further comprises moving the sliding frame assembly in a lateral plane in response to the platform movement. The method may further include restricting the movement of the x-axis frame along the x-axis, and restricting the movement of the z-axis frame along the z-axis.

An advantage of the present invention is that the system and method can be used on floating platforms. Another advantage is that the system and method provides for motion compensation on a well undergoing well intervention and remedial well work. Yet another advantage is that the apparatus can be used with other motion compensation devices such as the apparatus disclosed in U.S. patent application Ser. No. 10/736,267 entitled "Motion Compensation System and Method", filed 15 Dec. 2003, which is incorporated herein by express reference. Still yet another advantage is that the present invention allows for performing coiled tubing well work safely.

A feature of the present application is the use of a sliding frame assembly that allows the lateral movement of an attached structure relative to the apparatus. Another feature is the x-axis frame that supports an injector head on a floating platform, and wherein the x-axis frame pivots along the x-axis. Still yet another feature is the z-axis frame that supports an injector head on a floating platform, and wherein the z-axis frame pivots along the z-axis.

Another feature includes the modular design of the components. The modularity allows for ease of transportation, delivery and rig up. Yet another feature includes the ability to use the apparatus with a track stack, and wherein the track stack can be used to build the height needed on specific well applications by simply stacking spacers one on top of the other.

Another feature is that motion compensation is provided in the vertical direction and horizontal direction as well as along the x and z axis. Yet another feature is biasing means that restricts and controls the amount of pivoting of the z-axis frame and the x-axis frame. Still another feature is the use of an adapter frame that is part of the apparatus and connects to the injector head.

BRIEF DESCRIPTION OF THE DRAWINGS

FIG. 1B is an exploded isometric view of the top half of the apparatus of the preferred embodiment of the present invention.

DETAILED DESCRIPTION OF THE PREFERRED EMBODIMENTS

Figure 1A:
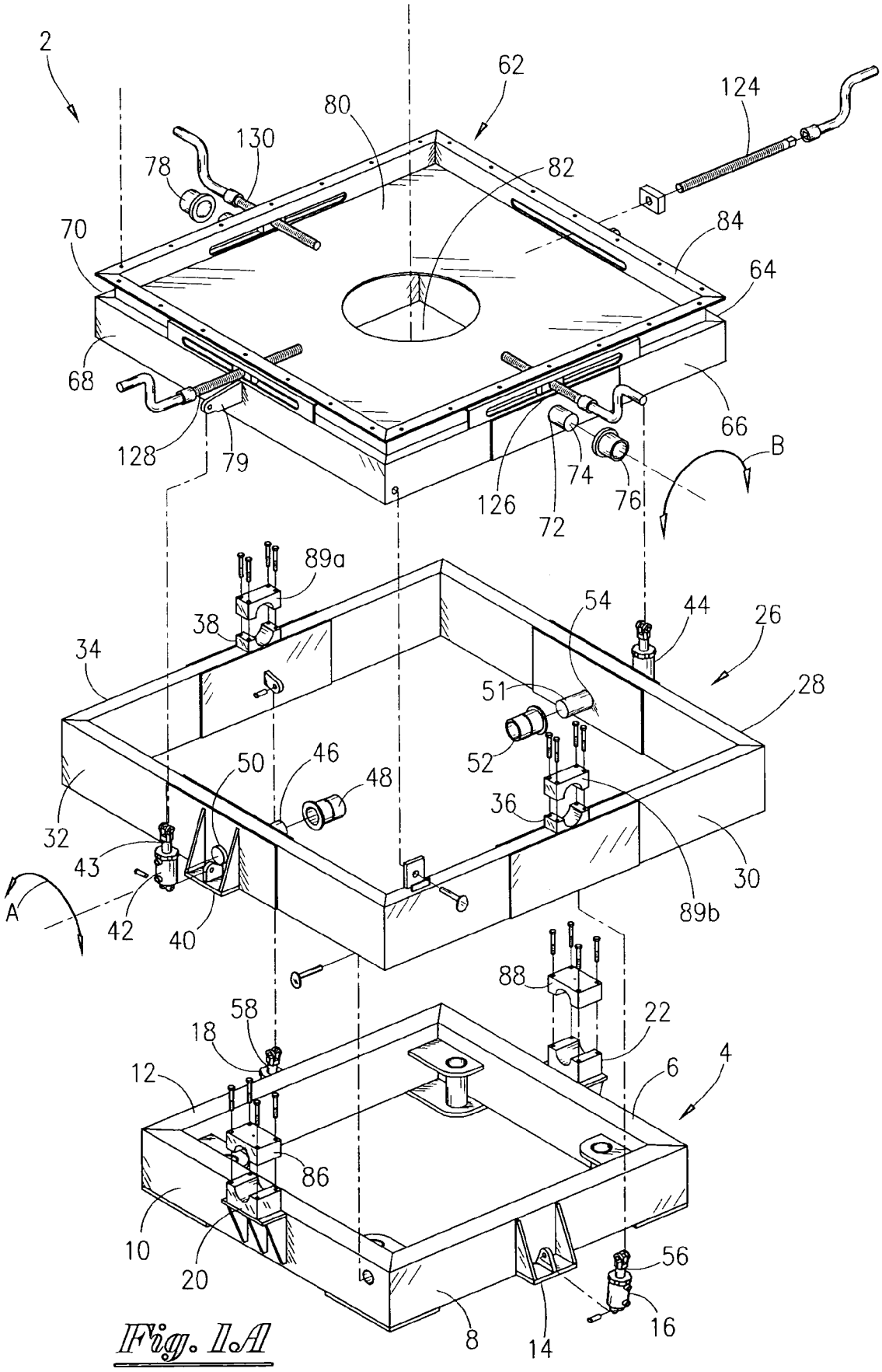
FIG. 1A is an exploded isometric view of the bottom half of the apparatus of the preferred embodiment of the present invention.
Figure 11B:
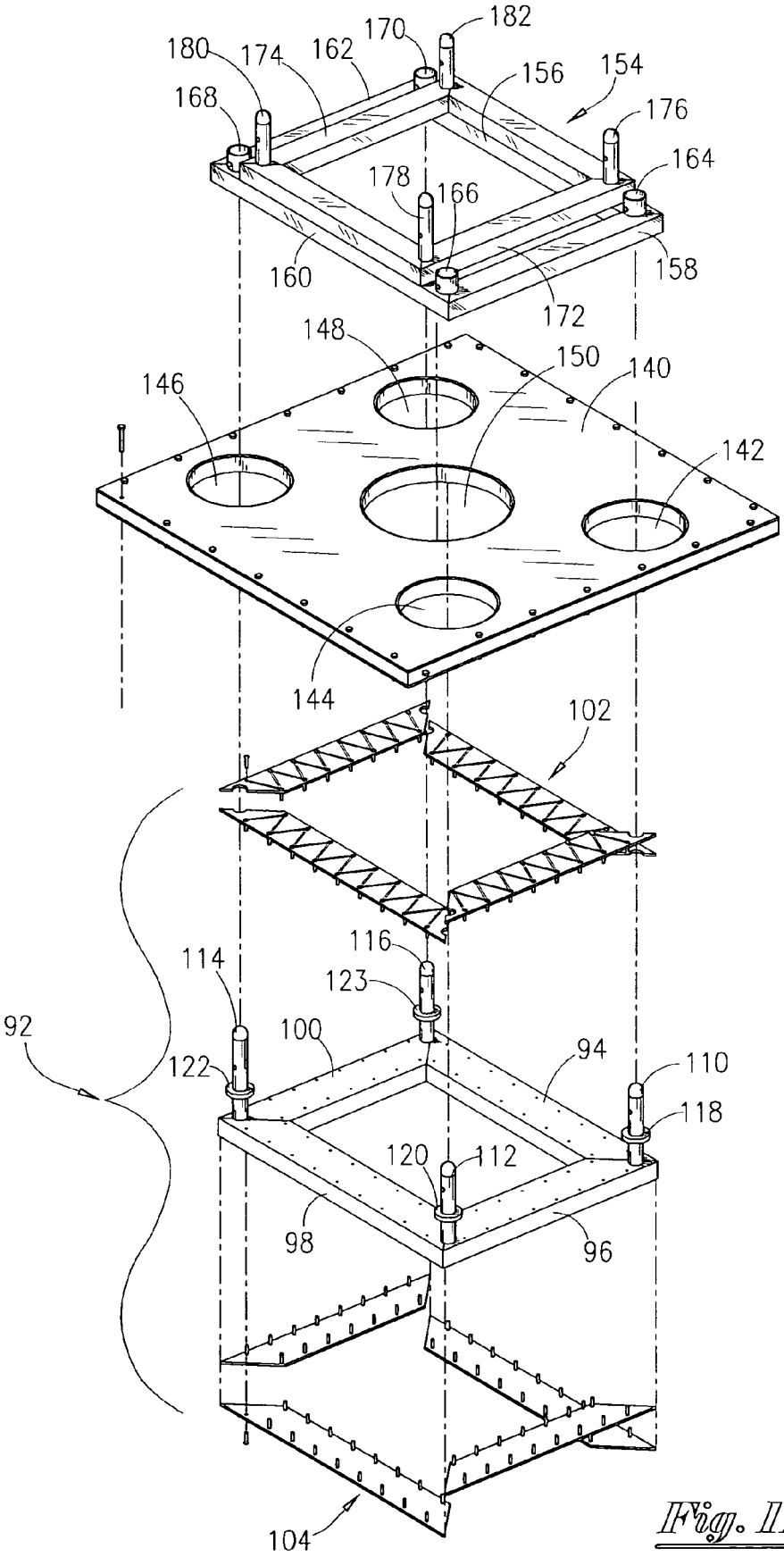

Referring now to FIG. 1A, an exploded isometric view of the apparatus 2 of the preferred embodiment of the present invention will now be described. The apparatus 2 contains a base frame 4, wherein the base frame 4 is generally rectangular having a first side 6, second side 8, third side 10, and fourth side 12. In the most preferred embodiment, the sides are of equal length so that the base frame is a square. The side 8 has a cylinder bracket 14 that will have operatively associated therewith the cylinder means 16. The side 12 has a cylinder bracket (not seen in this view) that will have operatively associated therewith the cylinder 18. The base frame 4 will also contain a first cradle 20 attached to the side 10, and a second cradle 22 attached to the side 6. As will be explained in greater detail later in the application, the base frame 4 is attached to the deck of a floating platform, such as a floating drilling rig.

The apparatus 2 further contains an x-axis frame 26 and wherein the x-axis frame 26 is generally rectangular, having the first side 28, second side 30, third side 32, and fourth side 34. The side 30 contains the cradle 36, and the side 34 contains the cradle 38. The side 32 contains the bracket 40 and the side 28 contains a bracket (not seen in this view). The bracket 40 will have a cylinder means 42 operatively associated therewith, while the other bracket will have cylinder means 44 operatively associated therewith. The cylinder means 42 has piston 43 extending therefrom. The x-axis frame 26, in the most preferred embodiment, is a square with the sides being of equal length. Also, in the most preferred embodiment, the sides of the x-axis frame 26 are longer than the sides of the base frame 4 so that the x-axis frame 26 can fit over the base frame 4.

The x-axis frame 26 further contains a pin 46 and bushing 48 that cooperate with the opening 50. The bushing 48 will fit into the cradle 20. A pin 51 and bushing 52 cooperate with the opening 54. The bushing 48 will cooperate with the cradle 20 forming a pivot point and the bushing 52 will cooperate with the cradle 22 forming a pivot point, which in turn will allow the x-axis frame 26 to pivot relative to the base frame 4 in the x-axis as seen by arrow A.

The cylinder means 16 will be attached at one end to the side 8, and the piston 56 will be attached to the side 30 of the x-axis frame 26. Cylinder will also be attached at one end to the side 12, and the piston 58 will be attached to the side 34 of the x-axis frame 26. In this way, the cylinder means 16 and 18 are means for restriction for the motion of the x-axis frame 26 in the x-axis. In the most preferred embodiment, the motion restriction means allows for the tilting of the x-axis frame 26 in a 2 degree plane in either direction, as will be more fully discussed in the written description of FIGS. 5 and 6.

Referring again to FIG. 1A, the z-axis frame 62, which is generally a rectangular frame. The z-axis frame 62 includes the side 64, side 66, side 68, and side 70. In the most preferred embodiment, the sides are of equal length thereby making the z-axis frame 62 a square. The side 66 contains an opening 72 that contains the pin 74 and bushing 76 therein. The side 70 contains an opening and pin (not shown in this view), as well as bushing 78. A bracket 79 is included that will be connected to the piston 43 as will be described later in the application. The z-axis frame 62 pivots in the z-axis as seen by arrow B.

A cover plate 80 attaches the sides of the z-axis frame 62, wherein the cover plate 80 contains an opening 82. The z-axis frame 62 further comprises a lip structure 84, that contains openings for placement of bolts (not seen in this view), and wherein the lip structure 84, which is in the shape of an inverted L, extends along the sides of the z-axis frame 62.

Also seen is the bottom pillow blocks 86 and 88 that is attached to the underside of the cover 80 that will cooperate with the bushings 48, 52, respectively, in order to keep the z-axis frame 62 in a stable state. Pillow blocks 89*a* and 89*b* are also attached to the underside of cover plate 80 and will cooperate with bushings 78, 76 in order to keep the z-axis frame 62 in a stable state.

Referring now to FIG. 1B, FIG. 1B also depicts the sliding frame assembly, seen generally at 92. The sliding frame assembly 92 is generally a rectangular frame having side 94, side 96, side 98, and side 100. In the preferred embodiment, a first strip of elastomer 102 (sometimes referred to as a sliding pad) is placed on the front sides and a second strip of elastomer 104 (sometimes referred to as a sliding pad) is placed on the opposite side. The second strip of elastomer 104 will contact the top face of cover plate 80 (seen in FIG. 1A) so that the sliding frame assembly 92 will slide on the top face of cover plate 80. Returning to FIG. 1B, the sliding pads 102 and 104 may be constructed of any material that reduces friction and allows for lateral movement. In the preferred embodiments, the sliding pads are commercially available from Acadiana Ruber & Gasket Inc. under the name Nylatron. Other types of materials could be used instead of the elastomer strip 102, such as rubber.

The sliding frame assembly 92 further comprises vertically extending rods, wherein the rods are positioned at each of the corners of the sliding frame assembly 92. FIG. 1 depicts the vertical rod 110, vertical rod 112, vertical rod 114, and vertical rod 116. The vertical rods 110–116 also have stop rings, namely stop ring 118, stop ring 120, stop ring 122, and stop ring 123 for the rod 116.

Returning to FIG. 1A, a means for locking the sliding frame assembly 92 from movement is also disclosed. The locking means prevents the sliding frame assembly 92 from moving. This may be required for some operations wherein it is desirable to keep the sliding frame assembly 92 from moving, or keeping the sliding frame assembly from shifting when transporting the apparatus 2, for instance. Also, the locking means can serve as an indexing tool to locate and position the sliding frame assembly 92. The means for locking comprises horizontal rods 124, 126, 128, 130 disposed through openings in the sides of the lip structure 84. As shown, the rods contain handles. In one embodiment, the openings in the sides of the lip structure 84 will contain a threaded block, and the rods will have mating threads, so that the rods 124–130 can be threaded into and out of the openings. In this way, the rods 124–130 can be advanced into the cavity and abut the sliding frame assembly 92 thereby locking the sliding frame assembly 92 in place.

Referring again to FIG. 1B, the assembly further comprises a top plate weldment 140, wherein the top plate weldment 140 will be attached to the lip structure 84 via conventional means such as nuts and bolts through the openings in the lip structure 84. Other attachment means includes welding the top plate weldment 140 to the lip structure 84. The top plate weldment 140 contains the corner opening 142, the corner opening 144, the corner opening 146, and the corner opening 148. The stop rings 118, 120, 122, 123 keep the injector head or the adapter frame above the openings 142, 144, 146, and 148. The top plate weldment 140 also contains the central opening 150. The vertical rod 110 will fit through the opening 142, the vertical rod 112 will fit through opening 144, the vertical rod 114 will fit through opening 146 and the vertical rod 116 will fit through opening 148.

FIG. 1B also depicts the adapter frame, seen generally at 154. As understood by those of ordinary skill in the art, the adapter frame 154 will be connected to the injector head (not seen in this view). The adapter frame 154 is generally rectangular with a first side 156, a second side 158, a third side 160, and a fourth side 162. At each of the corners, there is contained an opening for concentric placement of the vertical rods. Hence, the opening 164 is adapted to receive rod 110; opening 166 is adapted to receive rod 112; opening 168 is adapted to receive rod 114; and opening 170 is adapted to receive rod 116. The adapter frame 154 also has an elevated side 172 and an elevated side 174. Additionally, the adapter frame 154 also contains the vertical adapter rods 176, 178, 180, 182. The vertical adapter rods 176–182 are configured to engage the injector head. One of the advantages is that the adapter frame 154 can be differently sized to fit with various injector head sizes. In other words, the adapter frame 154 may be customized as being larger or smaller in order to accommodate a specific sized injector head.

Figure 2:
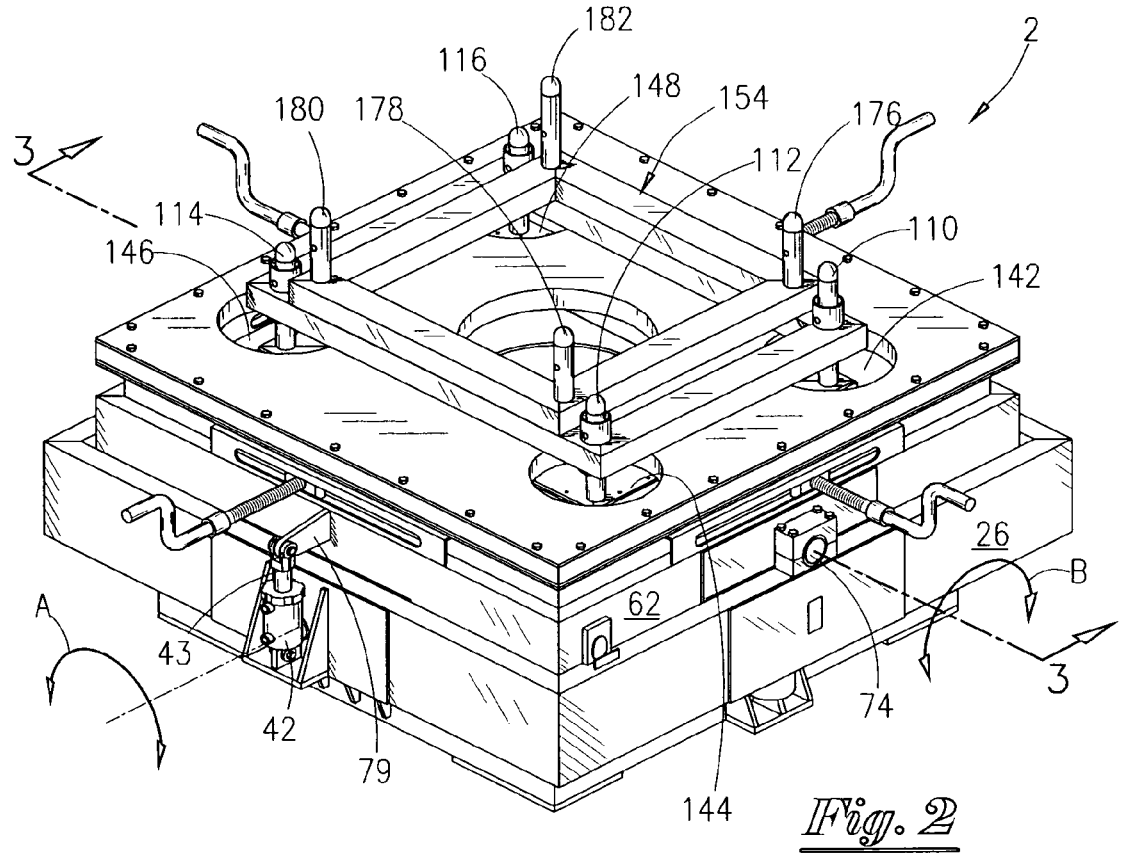
FIG. 2 is an isometric assembled view of the apparatus of the preferred embodiment of the present invention seen in FIGS. 1A and 1B.

Referring now to FIG. 2, an isometric assembled view of the apparatus 2 of the preferred embodiment seen in FIG. 1 will now be described. The z-axis frame 62 is pivotly attached to the x-axis frame 26 via the pin 74. The cylinder 42 has the piston 43 extending therefrom, and the piston is connected to bracket 79. As noted earlier, a second cylinder and piston (not shown in this view) will be connected on the opposite side in a similar manner. The cylinder 42 and piston 43 are part of the motion restriction system that will be explained in greater detail later in the application. The z-axis frame 62 can therefore be pivoted as shown by arrow B. The x-axis frame 26 can also be pivoted via the bushings 48, 52 (48, 52 not shown in this figure), as shown by arrow A.

Additionally, FIG. 2 depicts the vertical rods 110, 112, 114, and 116 extending through the openings 142, 144, 146, and 148, respectively. In this manner, the sliding pad 102 can slid on the cover plate 80 (as seen in FIGS. 1A and 1B), and the sliding frame assembly 92 (as seen in FIG. 1B) can move laterally a distance equal to the diameter of the openings 142, 144, 146, 148 in all directions. FIG. 2 further depicts the vertical adapter rods 176–182 that will be connected to the injector head. In this way, the adapter frame 154 will be connected to the injector head, and the injector head will be connected to the riser. Hence, the movement of the platform relative to the riser is compensated by the apparatus 2 herein disclosed.

Figure 3:
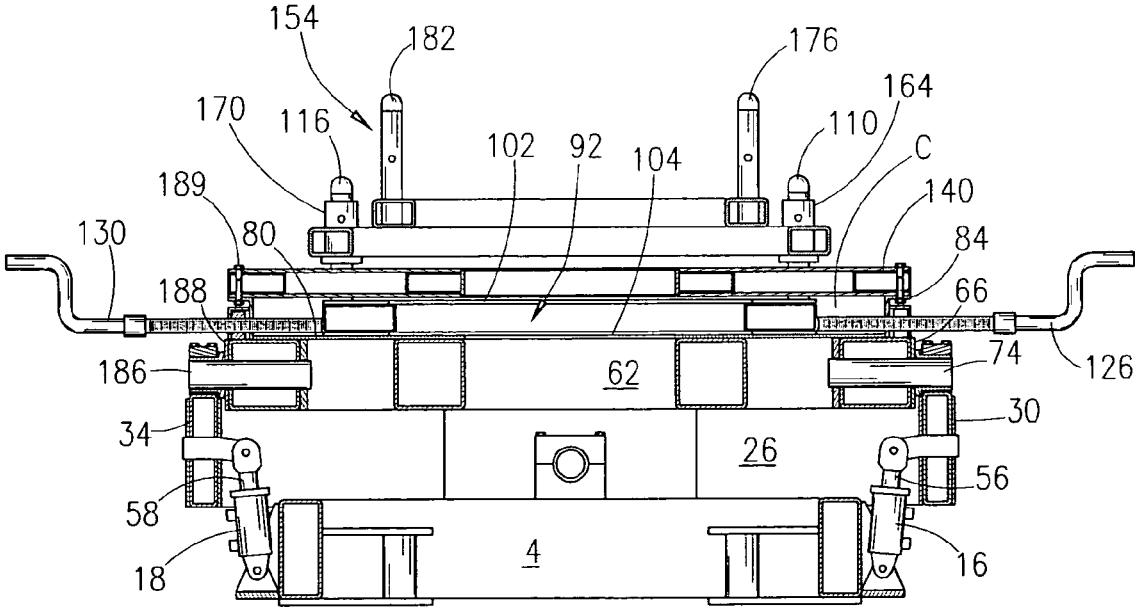
FIG. 3 is a cross-sectional view of the isometric illustration of the apparatus taken along line 3—3 of FIG. 2.

In FIG. 3, a cross-sectional view of the isometric illustration of the apparatus 2 taken along line 3—3 of FIG. 2 will now be described. The x-axis frame 26 is shown being connected to the base frame 4 wherein the cylinder 16 has the piston 56 that is connected to the side 30 of the x-axis frame 26 and the cylinder 18 has the piston 58 that is also connected to the side 34 of the x-axis frame 26. In the preferred embodiment shown in FIG. 3, the sides of the various frames are constructed of square tubular members.

The z-axis frame 62 has the pin 74 disposed through the side 66 of the z-axis frame 62 as well as the pin 186 disposed through the side 188 of the z-axis frame 62 so that the z-axis frame is pivotal as shown by the arrow B. Also, the cover plate 80 is shown.

FIG. 3 also depicts the top plate weldment 140 being attached via nuts and bolts, such as seen at 189. As noted earlier, the top plate weldment 140 is attached to the lip structure 84. As seen in FIG. 3, the top plate weldment 140 and the cover plate 80 form a cavity C that contains the sliding frame assembly 92. Note that the second strip elastomer 104 rest on the cover plate 80, however, the first strip elastomer 102 will not engage the top plate weldment 140 so that the sliding frame assembly 92 can laterally move within this cavity. The lateral movement will be limited by the diameter of the openings through the top plate weldment 140, for instance openings 142 and 148 seen in FIG. 3. The movement is limited since the vertical rods of the sliding frame assembly 92 are disposed through the openings, such as the vertical rod 110 and 116 seen in FIG. 3.

FIG. 3 also depicts the locking means for locking and indexing the sliding frame assembly 92, wherein the rods 126 and 130 are shown. The rods can be advanced through an opening in the sides of the z-axis frame via thread means. The rods will push the sliding frame assembly 92 and in this way, the sliding frame assembly 92 can be locked into place; also, the operator may use the locking means to index the sliding frame assembly into a known position within the cavity C.

The adapter frame 154 is shown in engagement with the vertical rods 110, 116 of the sliding frame assembly 92. As seen in FIG. 3, the vertical rod 110 is disposed through the opening 164 and the vertical rod 116 is disposed through the opening 170. As noted earlier, the adapter rods will connect to the base of a coiled tubing injector head in the preferred embodiment.

Figure 4:
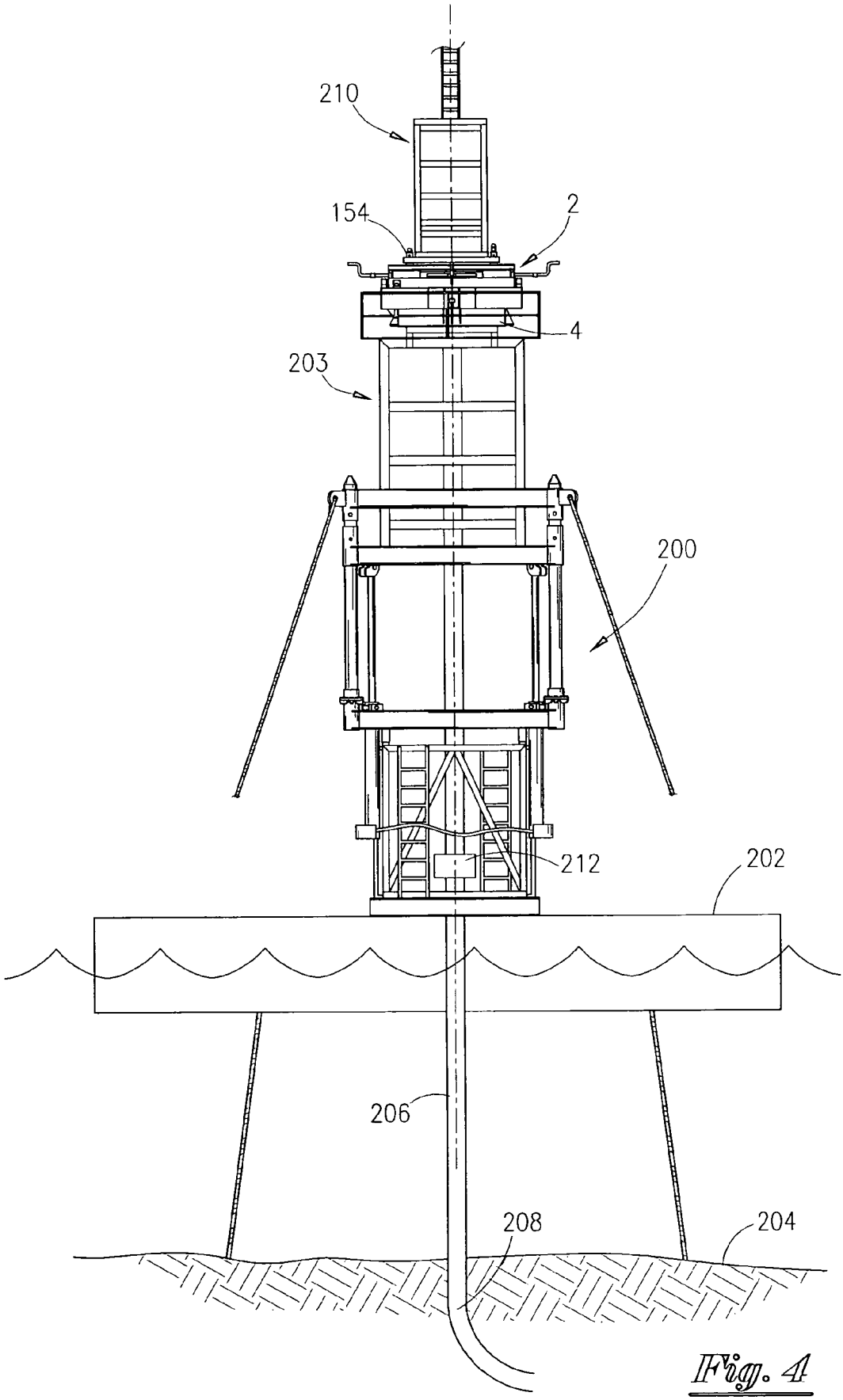
FIG. 4 is a schematic illustration of the apparatus of the present invention as part of the well intervention string assembly on a floating platform.

Referring now to FIG. 4, a schematic illustration of the apparatus 2 of the most preferred embodiment of the present invention as part of the well intervention string assembly on a floating platform, such as a semi-submersible drilling rig, will now be described. FIG. 4 depicts a motion compensation means 200 that is attached to a floating platform 202. The motion compensation system 200 was described in a patent application filed by applicant on 15 Dec. 2003 entitled "Motion Compensation System and Method", bearing Ser. No. 10/736,267, which is incorporated herein by reference. The motion compensation system is operatively connected to a track stack structure 203. The track stack structure 203 is commercially available from Devin International Inc. under the name Track Stack Jr. (hereinafter referred to as a track stack). The apparatus 2 is attached to the track stack structure 203. The purpose of the track stack is to allow movement of a supporting platform in a vertical plane as well as a horizontal plane.

The floating platform 202 will be tethered to the ocean floor 204 via conventional means such as anchors. A riser 206 extends from the ocean floor 204 to the platform 202. The riser 206 is connected at one end to the subterranean well 208, and at the other end to the coiled tubing injector head 210. The coiled tubing injector head 210 is commercially available from Hydra Rig Corporation under the name Coiled Tubing Injector Head. The adapter frame 154 is connected to the coiled tubing injector head 210. The base frame 4 is connected to the track stack 203 which is connected to the motion compensation means 200 which in turn is connected to the floating platform 202; hence, the base frame 4 is in effect attached to the floating platform 202. FIG. 4 also depicts a blow out preventor stack 212.

As noted earlier, the wave and tidal effects on the riser 206 and platform 202 do not occur in unison. The riser 206 and the coiled tubing injector head 210 will be held static for the most part since the riser 206 is connected to the subterranean well 208, while the floating platform 202 and attached base frame 4 will experience various buoyant forces thereby causing the base frame 4 to undergo heave, pitch and yawl, as understood by those of ordinary skill in the art. In the view of FIG. 4, the coiled tubing injector head 210 is still in a vertical orientation relative to the platform, and therefore, there is no tilting and/or pivoting in the apparatus 2.

Figure 5:
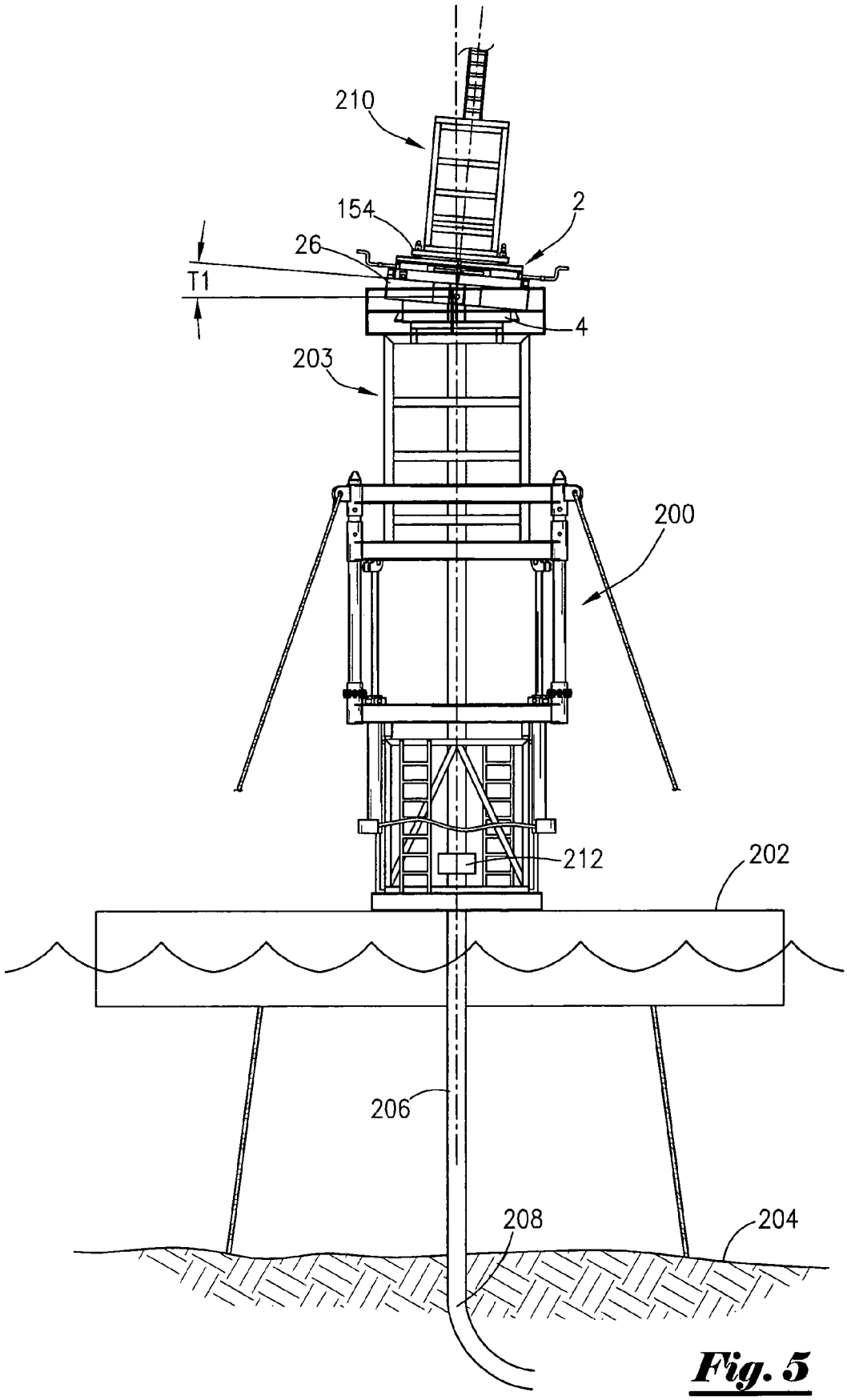
FIG. 5 is a schematic illustration of the apparatus seen in FIG. 4 with a tilt angle to the port side.
Figure 6:
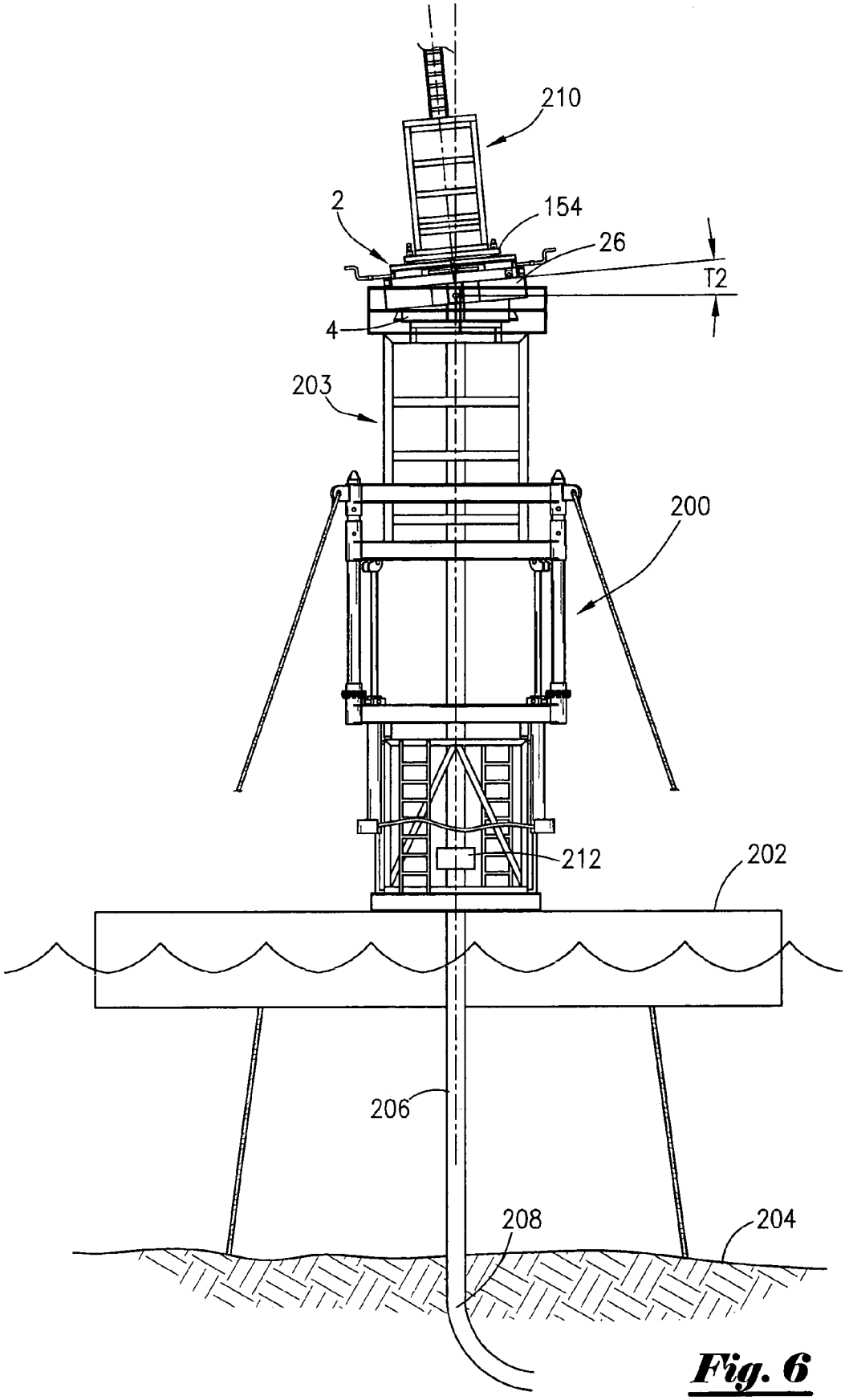
FIG. 6 is a schematic illustration of the apparatus seen in FIG. 4 with a tilt angle to the starboard side.

In FIG. 5, a schematic illustration of the apparatus 2 seen in FIG. 4 with a tilt angle "T1" of approximately 2 degrees to the port side is shown. Hence, in this sequence, the x-axis frame 26 has pivoted on the cradles 36, 38 (not shown in this view). Note that the cylinders 42, 44 (not shown in this view) act as a biasing means and prevents over rotation of the x-axis frame 26. FIG. 6 depicts the schematic illustration of the apparatus 2 seen in FIGS. 4 and 5, wherein the tilt angle of approximately 2 degrees "T2" is to the starboard side. As seen in FIG. 6, the x-axis frame 26 has pivoted on the cradles 36, 38 (not shown in this view).

Figure 7:
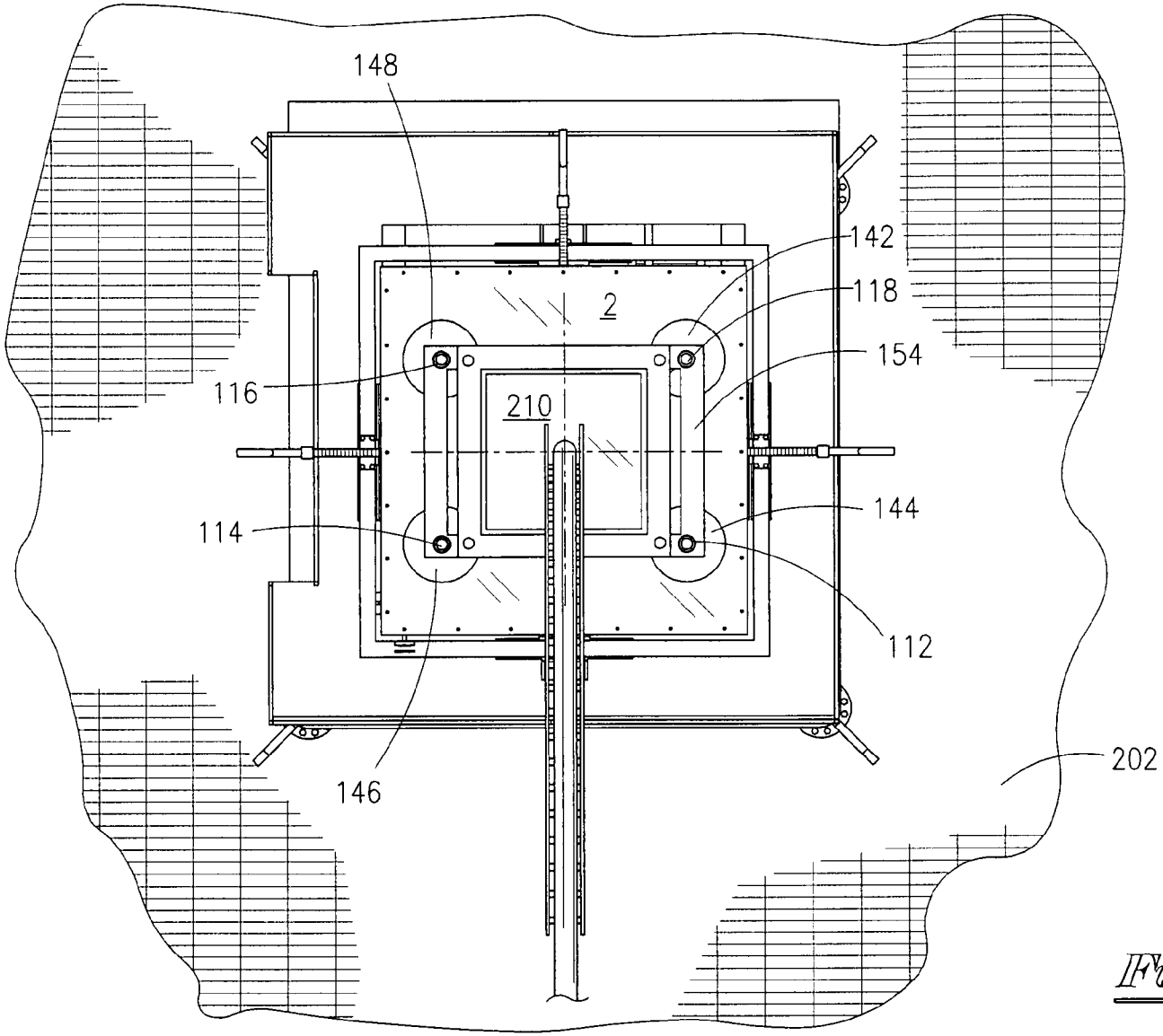
FIG. 7 is a schematic illustration of the top view of the apparatus seen in FIG. 4.

Referring now to FIG. 7, a schematic illustration of the top view of the apparatus 2 seen in FIG. 4 will now be discussed. The coiled tubing injector head 210 is attached to the adapter frame 154. Note that rods 112, 114, 116, and 118 are disposed concentrically through the openings 142, 144, 146, 148, respectively. In this view, the apparatus 2 is essentially centered.

Figure 8:
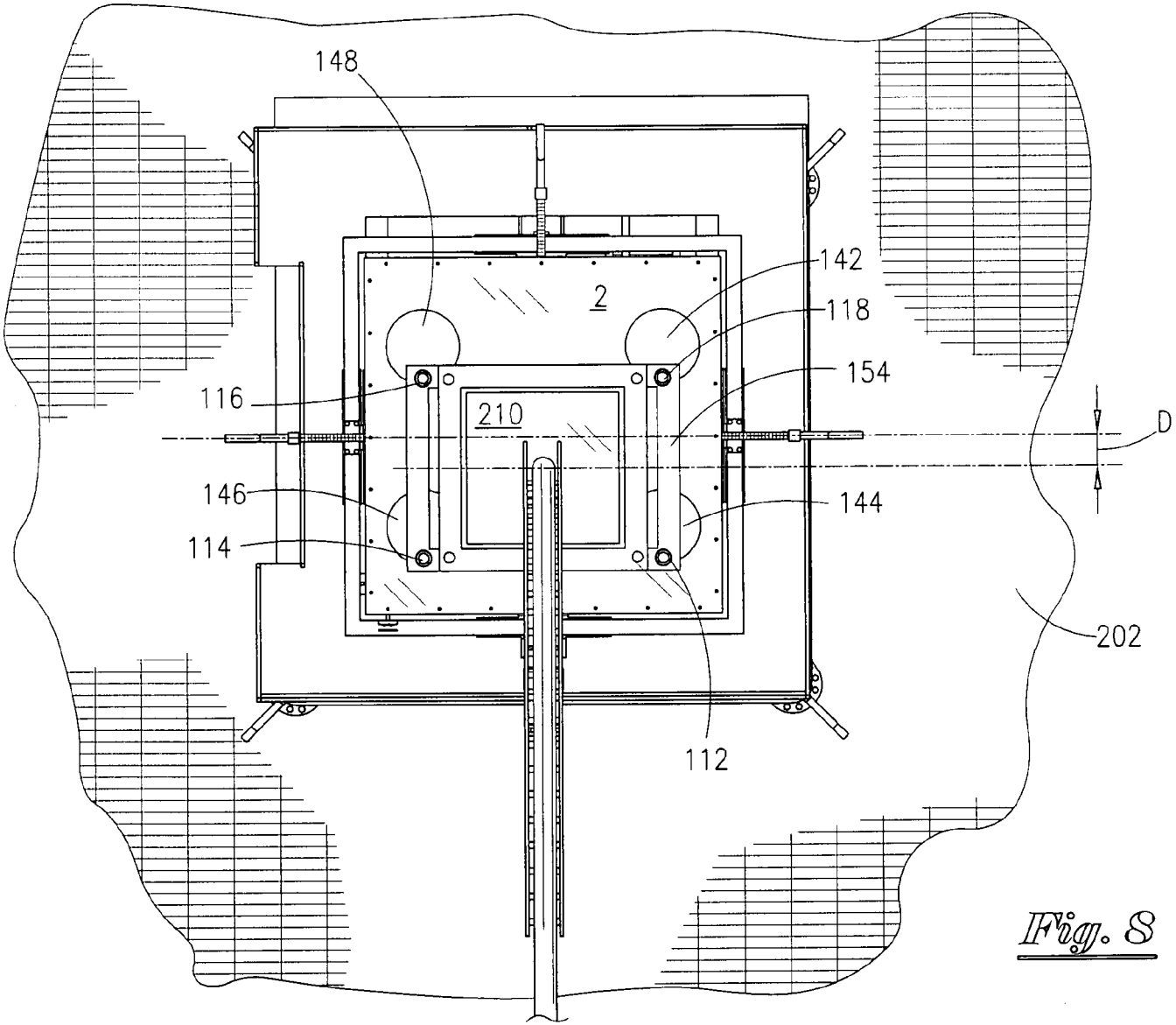
FIG. 8 is a schematic illustration of the top view of the apparatus seen in FIG. 4 depicting lateral travel.

FIG. 8 is a schematic illustration of the top view of the apparatus 2 seen in FIG. 7 depicting lateral travel. Thus, the motion of the entire well intervention string assembly and the platform 202 has caused lateral motion. FIG. 8 depicts the amount of lateral motion, represented by the arrow "D". In the preferred embodiment, the openings are 18 inches in diameter; therefore, there is a maximum travel of 9 inches in any one plane.

Figure 9:
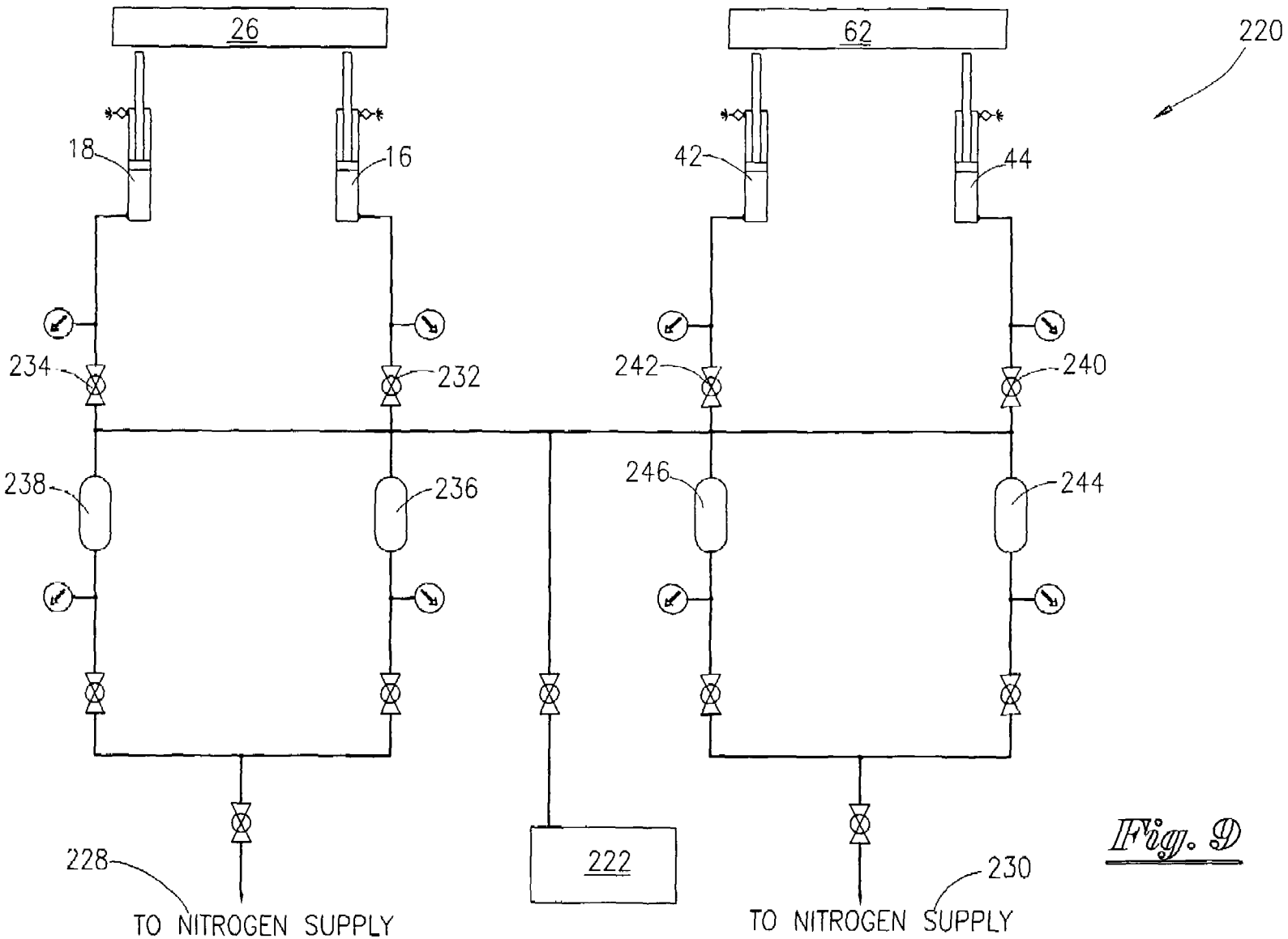
FIG. 9 is a schematic illustration of the motion restriction system of the present invention.

FIG. 9 is a schematic illustration of the motion compensation system 220 of the present invention which is also referred to as the motion restriction system. The motion compensation system 220 includes biasing means for biasing the x-axis frame 26, and wherein x-axis biasing means includes the cylinder 16 and the cylinder 18. The system 220 also includes biasing means for biasing the z-axis frame 62, and wherein the z-axis biasing means includes the cylinder 42 and cylinder 44. In the preferred embodiment, the cylinders will be powered via a hydraulic source 222. The cylinders 16, 18, 42, 44 serve to limit the pivoting movement of the relative frame, as well as providing a resistance to the pivoting movement. It should be noted that other biasing means could be provided. For instance, the cylinders could contain springs, and wherein the springs would both limit the pivoting range, as well as providing resistance to the pivoting motion. In the most preferred embodiment, a hydraulic system that has a nitrogen pressure source 228, 230 for maintaining the hydraulic fluid of the hydraulic system under pressure will be used as shown in FIG. 9.

The x-axis biasing means can be described as follows with reference to FIG. 9. The hydraulic supply 222 will be directed to valves 232, 234, then to the cylinders 18, 16. Valve means 232, 234 will allow the hydraulic fluid to the cylinders 16, 18 as shown. The nitrogen supply 228, which is pressurized nitrogen gas, is directed to the accumulators 236 and 238. Note that valves 232, 234 are in communication with accumulators 236, 238, and wherein the accumulators 236, 238 provide for additional volume and storage of the nitrogen gas in order to keep the system with the proper pressure. Thus, the x-axis biasing means can bias the x-axis frame 26 along the x-axis utilizing the pressurized hydraulic system shown.

The z-axis biasing means will now be described. The hydraulic supply 222 will be directed to valves 240, 242, then to the cylinders 42, 44. Valve means 240, 242 will allow the hydraulic fluid to the cylinders 42, 44 as shown. The nitrogen supply 230 is directed to the accumulators 244, 246. The valves 240, 242 are in communication with accumulators 236, 238, and wherein the accumulators 244, 246 provide for additional volume and storage of the nitrogen gas in order to keep the system pressurized. Hence, the z-axis biasing means can bias the z-axis frame 62 along the z-axis utilizing the pressurized hydraulic system shown.

Although the present invention has been described in terms of specific embodiments, it is anticipated that alterations and modifications thereof will no doubt become apparent to those skilled in the art. It is therefore intended that the following claims be interpreted as covering all such alterations and modifications as fall within the true spirit and scope of the invention.

We claim:

1. An apparatus for supporting an injector head on a platform comprising:

a base frame mounted to the platform, said base frame having a first bracket and a second bracket attached thereto;

a x-axis frame having a first pivot point and a second pivot point, and wherein said first pivot point is pivotly connected to said first bracket and said second pivot point is pivotly connected to said second bracket so that said x-axis frame pivots along an x axis, and wherein said x-axis frame has a third bracket and a fourth bracket;

a z-axis frame having a third pivot point and a fourth pivot point, and wherein said third pivot point is pivotly connected to said third bracket and said fourth pivot point is pivotly connected to said fourth bracket, and wherein said z-axis frame pivots along a z-axis;

a sliding frame assembly operatively positioned within said z-axis frame, and wherein said sliding frame assembly has a plurality of rods and wherein the injector head is operatively connected to said rods and wherein said sliding frame assembly comprises a sliding layer and an adapter frame and wherein said adapter frame is operatively connected with said rods; and wherein said sliding layer comprises a fabric so that the fabric slides on the surface of said z-axis frame;

a top plate attached to said z-axis frame so that a cavity is formed, and wherein said sliding frame assembly is contained within said cavity.

2. The apparatus of claim 1 wherein said injector head is connected to a riser wherein said platform is a floating platform.

3. The apparatus of claim 2 further comprising an x-axis biasing means for biasing said x-axis frame along the x-axis.

4. The apparatus of claim 3 further comprising a z-axis biasing means for biasing said z-axis frame along the z-axis.

5. The apparatus of claim 4 further comprising locking means for locking said sliding frame assembly.

6. The apparatus of claim 5 wherein said x-axis biasing means comprises: a first hydraulic cylinder attached to said base frame and a first piston extending from said first hydraulic cylinder, said first piston being attached to said x-axis frame.

7. The apparatus of claim 6 wherein said z-axis biasing means comprises: a second hydraulic cylinder attached to said x-axis frame and a second piston extending from said second hydraulic cylinder, said second piston being attached to said z-axis frame.

8. An apparatus for supporting a coiled tubing injector head comprising:

a base frame mounted to a track stack structure, said base frame having a first bracket and a second bracket attached thereto;

a x-axis frame having a first pivot point and a second pivot point, and wherein said first pivot point is pivotly connected to said first bracket and said second pivot point is pivotly connected to said second bracket so that said x-axis frame is pivots along a x-axis, and wherein said x-axis frame has a third bracket and a fourth bracket;

a z-axis frame having a third pivot point and a fourth pivot point, and wherein said third pivot point is pivotly connected to said third bracket and said fourth pivot point is pivotly connected to said fourth bracket, and wherein said z-axis frame is pivots along a z-axis;

a sliding frame assembly operatively positioned within said z-axis frame, and wherein said sliding frame assembly has a plurality of rods and wherein the injector head is operatively connected to said rods and wherein said sliding frame assembly comprises a fabric so that the fabric slides on a top surface of said z-axis frame;

a top plate attached to said z-axis frame so that a cavity is formed, and wherein said sliding frame assembly is contained within said cavity;

motion restriction means for restricting the x-axis frame movement along the x-axis and the z-axis frame movement along the z-axis.

9. The apparatus of claim 8 wherein said injector head is connected to a riser and wherein said base frame is connected to a floating platform.

10. The apparatus of claim 9 wherein said motion restriction means comprises an x-axis biasing means for biasing said x-axis frame along the x-axis.

11. The apparatus of claim 10 wherein said motion restriction means further comprises a z-axis biasing means for biasing said z-axis frame along the z-axis.

12. The apparatus of claim 11 further comprising locking means for locking said sliding frame assembly.

13. The apparatus of claim 12 wherein said x-axis biasing means comprises: a first hydraulic cylinder attached to said base frame and a first piston extending from said first hydraulic cylinder, said first piston being attached to said x-axis frame.

14. The apparatus of claim 13 wherein said z-axis biasing means comprises: a second hydraulic cylinder attached to said x-axis frame and a second piston extending from said second hydraulic cylinder, said second piston being attached to said z-axis frame.

15. An apparatus for supporting a coiled tubing injector head comprising:

a base frame mounted to a track stack structure, said base frame having a first bracket and a second bracket attached thereto;

a x-axis frame having a first pivot point and a second pivot point, and wherein said first pivot point is pivotly connected to saidfirst bracket and said second pivot point is pivotly connected to said second bracket so that said x-axis frame is movable along a x-axis, and wherein said x-axis frame has a third bracket and a fourth bracket;

a z-axis frame having a third pivot point and a fourth pivot point, and wherein said third pivot point is pivotly connected said third bracket and said fourth pivot point is pivotly connected to said fourth bracket, and wherein said z-axis frame is movable along a z-axis;

a sliding frame assembly operatively positioned within said z-axis frame, and wherein said sliding frame assembly has a plurality of rods, and wherein said sliding frame assembly comprises a sliding pad and and adapter frame operatively connected with said rods;

a top plate attached to said z-axis frame so that a cavity is formed, and wherein said sliding frame assembly is contained within said cavity;

motion restriction means for restriction the x-axis frame movement along t;he x-axis and the z-axis frame movement along the z-axis.

* * * * *